United States Patent [19]

Foote et al.

[11] Patent Number: 4,989,780

[45] Date of Patent: Feb. 5, 1991

[54] BLANK FOR SEALED CARTON WITH INTEGRAL RECLOSABLE POUR-OUT SPOUT

[75] Inventors: James B. Foote; James A. Karabedian, both of Toledo, Ohio

[73] Assignee: Owens-Illinois Plastic Products Inc., Toledo, Ohio

[21] Appl. No.: 798,217

[22] Filed: Nov. 14, 1985

Related U.S. Application Data

[63] Continuation-in-part of Ser. No. 638,145, Aug. 6, 1984, abandoned, and a continuation-in-part of Ser. No. 638,144, Aug. 6, 1984, abandoned.

[51] Int. Cl.[5] ..... B65D 5/74

[52] U.S. Cl. ..... 229/125.42; 229/3.5 R; 229/132; 229/133

[58] Field of Search ..... 229/3.5 R, 37 R, 38, 229/7 R, 17 R, 44 R, 125, 42, 132, 133; 206/622, 626

[56] References Cited

U.S. PATENT DOCUMENTS

| | | | |
|---|---|---|---|
| Re. 30,098 | 9/1979 | Titchenal et al. | 229/3.5 R |
| 1,723,150 | 8/1929 | Gannon et al. | 229/37 R |
| 1,987,647 | 1/1935 | Wellman | 229/37 R |
| 2,064,029 | 12/1936 | Murray | 229/17 R |
| 2,205,068 | 6/1940 | Potter | 229/17 R |
| 2,516,085 | 7/1950 | Williamson | 229/37 R |
| 2,553,803 | 5/1951 | Zinn, Jr. | 229/37 R |
| 2,729,385 | 1/1956 | Moore | 229/37 R |
| 3,038,649 | 6/1962 | Rausing | 229/17 R |
| 3,095,135 | 6/1963 | Hennessey | 229/17 R |
| 3,185,374 | 5/1965 | Feeney | 229/17 R |
| 3,270,945 | 9/1966 | Whitaker et al. | 229/17 R |
| 3,389,849 | 6/1968 | Egleston | 229/17 G |
| 3,533,549 | 10/1970 | Gilchrist et al. | 229/37 R |
| 3,577,484 | 5/1971 | Jacobson | 229/3.5 R |
| 3,650,458 | 3/1972 | Rausing | 229/17 R |
| 3,853,260 | 12/1974 | Wood | 229/37 R |
| 3,985,284 | 10/1976 | Palsson | 229/3.5 R |
| 4,078,715 | 3/1978 | Larsson et al. | 229/17 R |

FOREIGN PATENT DOCUMENTS

| | | | |
|---|---|---|---|
| 43049 | 9/1930 | Fed. Rep. of Germany | 229/17 R |
| 1173601 | 2/1959 | France | 229/17 R |
| 1514855 | 1/1968 | France | 229/37 R |
| 623494 | 7/1961 | Italy | 229/37 R |
| 269766 | 4/1927 | United Kingdom | 229/17 R |
| 527447 | 10/1940 | United Kingdom | 229/17 R |

*Primary Examiner*—Gary E. Elkins

[57] ABSTRACT

A six-sided sealed carton which is formed by folding a generally rigid, unitary, die-cut blank of a composite polymeric material, in which one of the ends is provided with a reclosable pour-out spout that includes an integral part of the blank, at least some of the corners of such carton being self-sealed by webbed areas or gussets which are integral portions of such blank but which are of reduced thickness relative to the major portions of the remainder thereof, such carton being adapted to contain a particulate material which is in direct contact with the inner surfaces thereof. In a preferred embodiment the carton is formed from a die-cut sheet of a composite polymeric material, a major portion of the thickness of which is an expanded polymeric material.

5 Claims, 6 Drawing Sheets

BLANK FOR SEALED CARTON WITH INTEGRAL RECLOSABLE POUR-OUT SPOUT

CROSS REFERENCE TO RELATED APPLICATIONS

This application is a continuation-in-part of our co-pending applications Ser. No. 638,145, filed on Aug. 6, 1984, and Ser. No. 638,144, filed on Aug. 6, 1984. The disclosure of each of such co-pending applications is hereby incorporated herein by reference.

BACKGROUND OF THE INVENTION

This invention relates generally to a sealed six-sided or parallelepiped carton which is formed by folding a generally rigid, unitary, die-cut blank, and more particularly to a carton of such character in which at least some of the corners are sealed by means which are a part of such blank to seal the contents of the carton and to thereby prevent the egress of the contents of the carton and the entry of oxygen and moisture from the atmosphere into the carton. The carton is adapted to contain particulate materials in direct contact with the inside surfaces of the carton and has an integral reclosable pour-out spout to permit the removal of a portion of such particulate materials and the subsequent reclosing of the carton. More particularly, this invention relates to a carton of such character in which the blank is formed from a polymeric material and, even more particularly, to such a carton in which such polymeric material is a composite material, a major portion of the thickness of which includes an expanded polymeric material.

Six-sided folding cartons are widely used for the packaging of many different kinds of particulate materials, such as breakfast cereals and powdered laundry detergents. One of the problems associated with the use of such cartons for these applications is the problem of removing only a portion of the contents of the carton. When only a portion of the contents of the carton is removed it is necessary to provide means to reclose the carton to prevent spillage of the remaining portion of the contents and in some cases to protect such contents from the deleterious effects of continuing contact with oxygen or moisture in the atmosphere. In many instances, for example in the case of the packaging of many breakfast cereals, this problem is solved by packaging the product in a plastic film or waxed paper bag which, in turn, is packaged in the folding carton. In such a carton, the contents are removed by opening an end of the carton to provide access to the inner bag, and this bag can be reclosed by folding after some of the contents have been removed therefrom. However, such a carton construction requires the use of the separate inner bag which adds to the cost of the materials used for the packaging application in question and to the complexity of the process for the filling of the carton. Further, in various prior art six-sided cartons, the use of such an inner bag is needed to help prevent oxygen and moisture in the atmosphere from entering the contents of the carton through the gaps or spaces which are normally formed at the corners of such cartons. Further, such cartons are usually formed by folding a generally rigid, unitary, foldable sheetlike material, a type of material that is permeable by moisture and/or oxygen from the atmosphere.

Another carton style which has proven to be popular for the packaging of some particulate materials, usually those which are relatively small in particulate size and excluding breakfast cereals, therefore, involves the use of a separate, movable pour-out spout which is attached to one of the surfaces of the carton in an opening therein. Such an attachment, which is usually made of a thin metal sheet, does permit the removal of a portion of the contents of a carton which does not include an inner bag, and the reclosing of such carton. However, again the use of a separate attachment adds to the cost and complexity of such a carton, and such attachments are generally rather small and are extensively utilized only in the packaging of particulate materials which are relatively small in size.

Generally, rigid polymeric materials, including expanded or foamed polymeric materials, offer many advantages over paperboard as a material of construction, including attractive appearance, relatively low cost, moisture imperviousness and good strength and rigidity characteristics in relationship to thickness and weight, and for these reasons these materials have captured important segments of packaging markets which were once held by paperboard. To date, however, polymeric materials have not been able to displace paperboard or other fibrous materials as the material of construction for folding boxes or cartons for breakfast cereals and other dry or particulate products to any great extent, at least in part due to the problems which relate to the sealing of the corners of such cartons.

SUMMARY OF THE INVENTION

According to the present invention there is provided a six-sided carton which is formed by folding a generally rigid, unitary, die-cut blank of a suitable polymeric sheetlike material, such carton being suitable to directly contain its contents without the need for an inner bag, and which includes an integrally formed reclosable pour-out spout to permit the removal of a portion of the contents of the carton and the reclosing of the carton. The carton is formed from a polymeric material, with a major portion of the thickness thereof including an expanded or foamed polymeric material, and this polymeric material has thickness, strength, rigidity and weight characteristics which compare favorably to the grades of paperboard that have heretofore been widely used in the manufacture of such cartons, and offers certain advantages relative to paperboard including attractive appearance, low cost, and moisture imperviousness. Such a carton is provided with integral means to seal the corners thereof, thereby eliminating the need for an inner bag or other separate means for accomplishing the sealing of the corners, and may be used to advantage in the packaging of a breakfast cereal or other particulate material of a relatively large particle size. The pour-out spout of such carton may be made large enough to permit the free flow of such particulate material therethrough. The function of sealing the corners of the carton is accomplished by providing webbed areas or gussets in at least some of the end flap portions of the blanks adjacent the scored lines therein which define the lines along which the blank is folded to form the carton, and by compressing these webbed areas or gussets to permit them to be folded into relatively thin sealing means lying between the folded over end flaps which define one or both of a pair of the sides of the carton, usually the top and bottom, at the corners of such sides.

Accordingly, objects of the present invention are to provide a sealed folding carton with an integral reclosable pour-out spout, which carton is adapted to contain a particulate material without the need for a separate inner bag, and a blank from which such a carton may be formed by folding. More particularly, objects of the present invention are to provide such a carton which is formed from a die-cut blank of a suitable polymeric material, a major portion of the thickness of which includes an expanded polymeric material, and a blank from which such a carton may be formed. Even more particularly, objects of the present invention are to provide a sealed carton which is formed from a generally rigid foldable blank of a sheetlike polymeric material, at least a major portion of which includes an expanded polymeric material, and to provide a blank of polymeric material, at least a major portion of which includes an expanded polymeric material, from which such a carton can be formed. Objects of the present invention are also to provide an improved sealed six-sided carton which is formed from a generally rigid, foldable blank of a sheetlike polymeric material, at least a major portion of which includes an expanded polymeric material and which has at least some of the corners of such carton sealed by means which include an integral portion of such a blank, and a blank from which such a carton can be formed.

For a further description of the present invention and the objects thereof, attention is directed to the drawing and the following description thereof, to the detailed description of the invention and to the appended claims.

DETAILED DESCRIPTION OF THE PREFERRED EMBODIMENT

Figure 1:
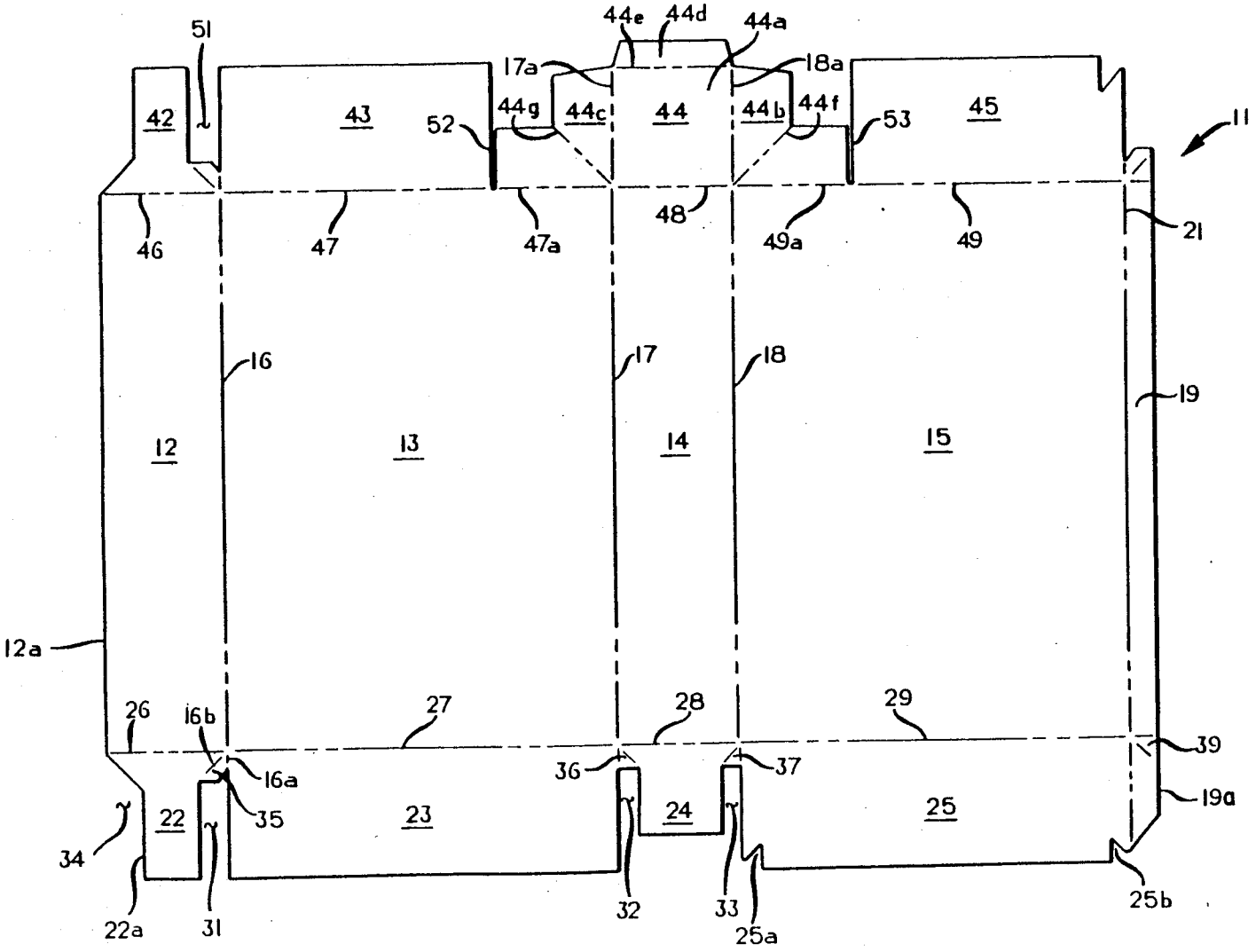
FIG. 1 is a plan view of a preferred embodiment of a blank according to the present invention.
Figure 2:
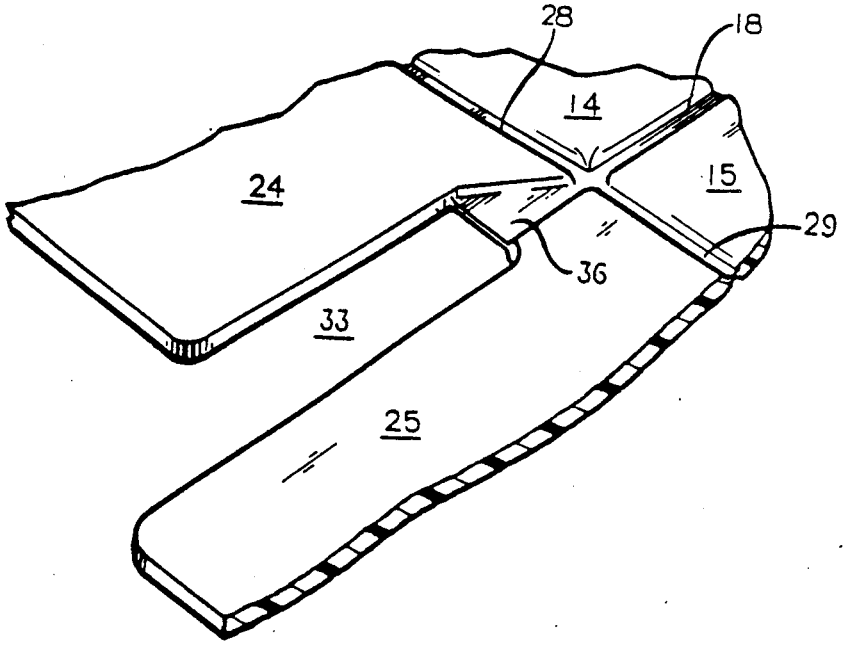
FIG. 2 is an enlarged fragmentary schematic view showing a portion of the blank of FIG. 1.

As is shown in FIG. 1, there is provided a die-cut blank, generally indicated by reference numeral 11, from which a parallelepiped or six-sided carton may be formed. In the case of a blank for a carton for the packaging of a breakfast cereal, the blank 11 may be advantageously formed from expanded general purpose or impact polystyrene in a thickness of the order of 36–40 mils (0.036–0.040 in.) and of a density of the order of 6–8 pounds per cubic foot. Preferably the blank 11 is also provided with thin layers of a non-expanded polymeric material, such as polyethylene, on the opposed surfaces thereof for improved resistance to moisture vapor transmission. These surface layers, for example 1.5 mils in thickness on the outside surface and 0.5 mils in thickness on the inside surface, can be formed on a core of expanded polystyrene by co-extrusion, extrusion coating or lamination in a known manner, and preferably involve the use of a suitable agent to effect bonding of these dissimilar materials, such as ethylene vinyl acetate, which can be utilized between the layers or in one or both of the adjoining layers. In any case, the blank 11 includes serially connected rectangularly shaped panels 12, 13, 14 and 15 which are integrally connected to one another and which are formed by scoring the blank 11 along fold lines 16, 17, and 18. Also formed in the blank 11 is a flap 19 which is integrally connected to the panel 15 along a fold line 21, which may also be formed by scoring.

Figure 3:
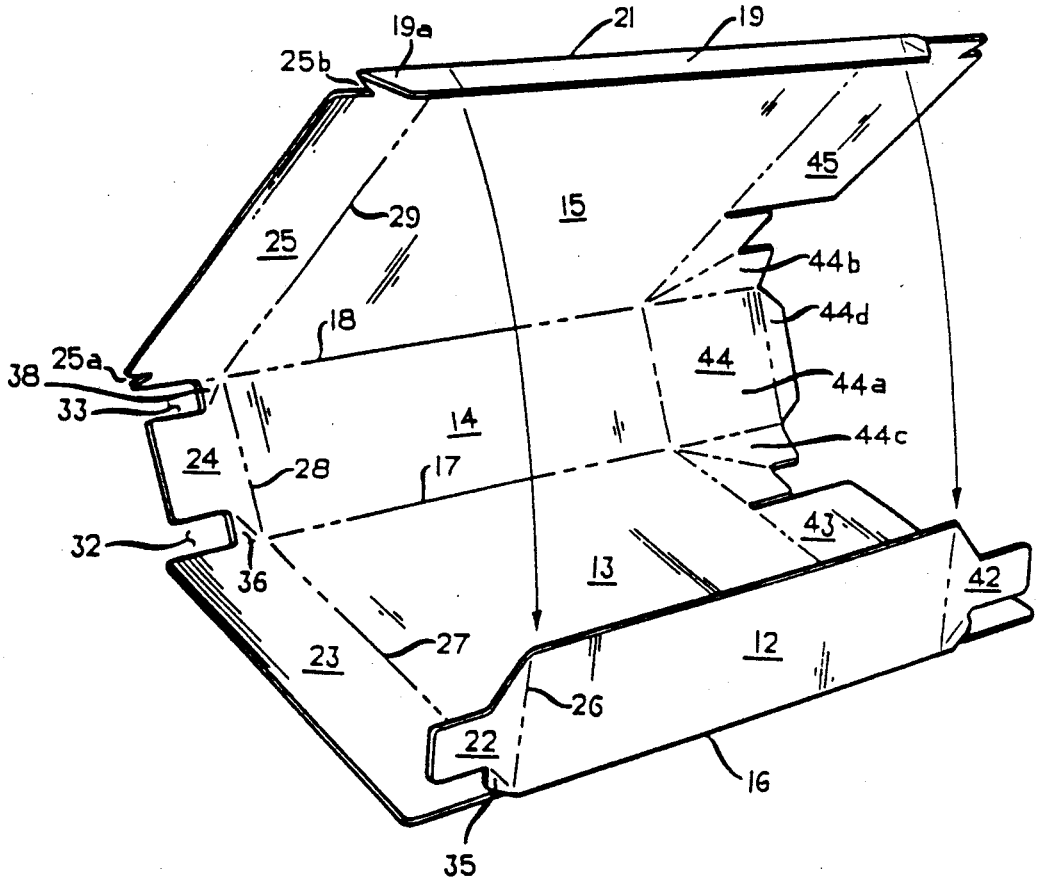
FIG. 3 is a schematic view showing the blank of FIG. 1 in a preliminary stage of the forming of a carton therefrom.
Figure 4:
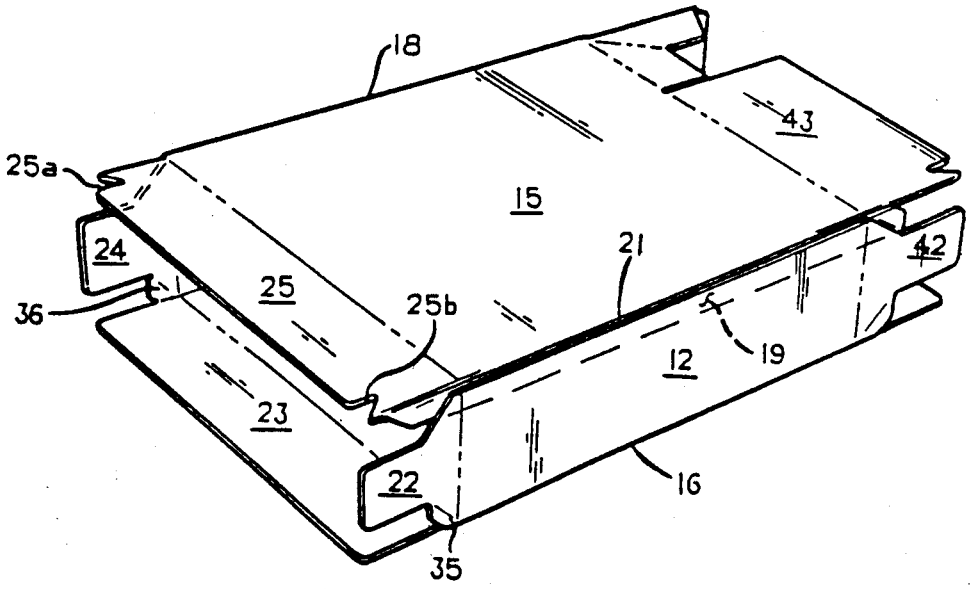
FIG. 4 is a schematic view showing a partially formed carton which has been formed from the blank of FIG. 1.

As is depicted in FIGS. 3 and 4, the forming of a carton from the blank 11 involves folding the blank along the fold lines 16, 17, 18, and 21 into a tubular configuration, to bring the panel 12 into a position overlying the flap 19 to form the side seam of the carton. The panel 12 and flap 19 are joined to one another in this tubular configuration by heat sealing or by the use of an adhesive, or by other known means for forming a joint in a carton.

The portion of the carton which normally includes the bottom of the carton when it is in an upright position is formed by a series of flaps 22, 23, 24, and 25 which are integrally attached to panels 12, 13, 14, and 15, respectively, along aligned fold lines 26, 27, 28, and 29. Such bottom construction is of the self-sealing type, as will subsequently be described more fully. The flaps 22, 23, 24, and 25 are separated from one another by slots 31, 32, and 33 which, to form the corner sealing means in the corners of the bottom structure of the carton, extend only partially to the fold line consisting of the fold lines 26, 27, 28, and 29. For the same reason, the outermost marginal portion of the edge **22*a* of the flap 22 is inwardly offset from the edge 12*a* of the blank 11. The slot 31 helps to define, with an extension 16*a* of the fold line 16 and a fold line 16*b* extending from the juncture of the fold lines 27 and 16 outwardly to the flap 22, a generally triangularly-shaped gusset area 35 in the blank 11. This gusset area is compressed to substantially less than its original thickness in the die-cutting operation which is utilized to form the blank 11, for example, to about the thickness of the scored fold lines or about no more than one-half the original thickness of the blank 11. Similar triangularly-shaped compressed gusset areas 36 and 37 are formed between the ends of the slots 32 and 33, respectively, and another triangularly-shaped compressed gusset area 39 is formed in the extension 19*a* which extends beyond fold line 29, almost to the end of the flap 25**.

Figure 5:
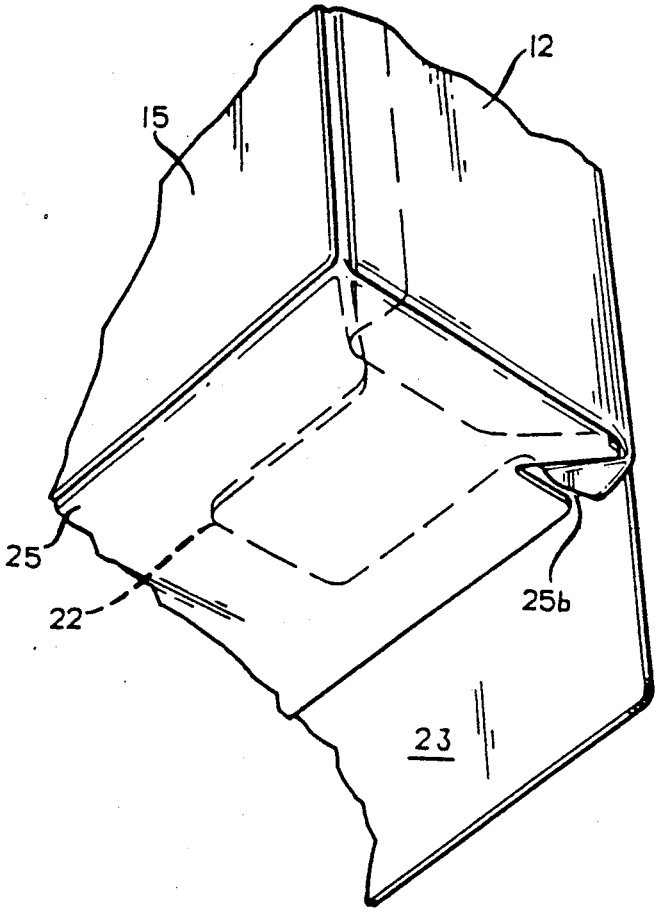
FIG. 5 is an enlarged fragmentary schematic view showing a portion of a carton as it is being formed from the blank of FIG. 1.

As is partially shown in FIG. 5, the end structure for the carton to be formed from the blank 11 is formed by folding the end flaps 22 and 24 to extend inwardly from the panels 12 and 14 and generally at right angles thereto. One of the remaining flaps, shown as flap 25, is then inwardly folded to overlie the flaps 22 and 24, and the remaining flap, shown as flap 23, is then inwardly folded to overlie flap 25. The innermost of the flaps 23 and 25, shown as flap 25, may be advantageously provided with triangularly-shaped notched areas 25*a* and 25*b* in its outer corners to engage one of the pair of gusset areas, shown as gusset areas 35 and 36, to help rigidify the corner areas of the bottom of the carton. In any case, the gusset areas 35 and 39 are brought into positions overlying the flap 22, and gusset areas 36 and 37 are brought into position overlying the flap 24, to effectively seal the corners formed at the bottom of the carton. The superimposed flaps may then be joined to one another, as by heat-sealing, to permanently secure the bottom structure of the carton.

At the top of the carton one end thereof is provided with a reclosable pour-out spout . The end away from the reclosable pour-out spout is formed by a flap 42 which is attached to the panel 12 along a fold line 46 similar to the attachment of flap 22 along fold line 26, and by partial flaps 43 and 45 which are attached to the panels 13 and 15 along fold lines 47 and 49, respectively, the flap 43 being separated from the flap 42 by a partial depth slot 51 (which is similar to the slot 31). The pour-out feature is provided by an irregularly shaped flap 44 which is attached partially to the panel 14 along a fold line 48 and partially to the panels 13 and 15 along inwardly extending portions 47*a* and 49*a* of fold lines 47 and 49, respectively. The flap 44 includes a rectangularly shaped central portion 44*a* and generally L-shaped portions 44*b* and 44*c* which extend outwardly from opposite sides of the central portion 44*a* and which are foldable relative to the central portion 44*a* along fold lines 18*a* and 17*a*, respectively. The fold lines 18*a* and 17*a*, in turn, respectively constitute extensions of fold lines 18 and 17. The flap 44 also includes an outwardly extending marginal tab portion 44*d* which is attached to the central portion 44*a* along a fold line 44*e*. Additionally, the legs of the L-shaped portions 44*b* and 44*c* are separated from one another along fold lines 44*f* and 44*g*, respectively, and the edges of the flap 44 are separated from the flaps 43 and 45 by narrow slots 52 and 53, respectively.

Figure 6:
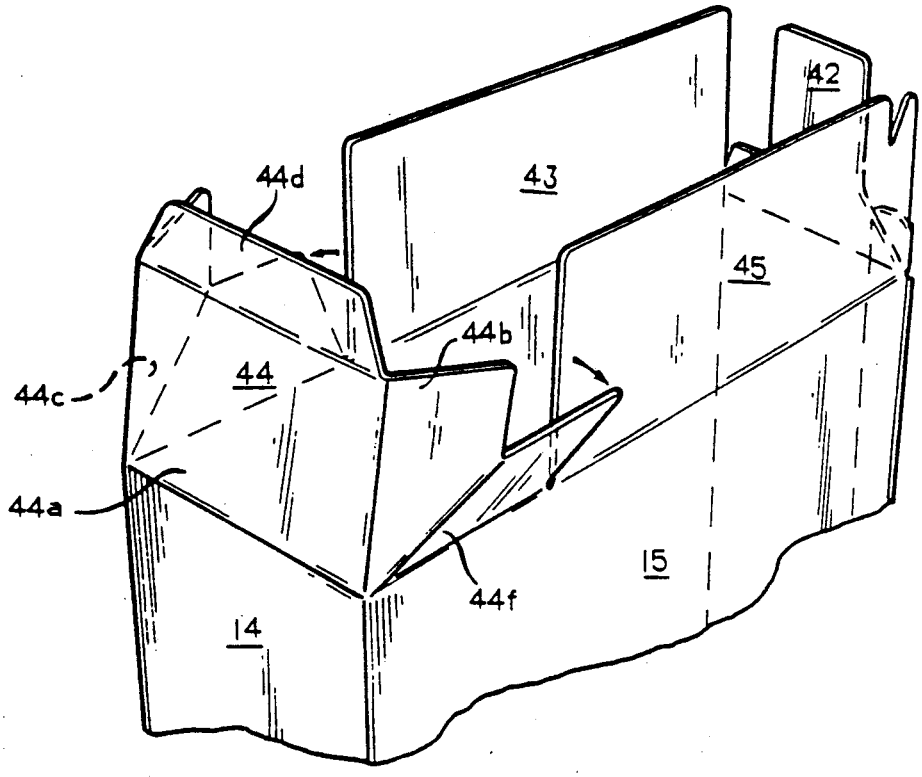
FIG. 6 is an enlarged fragmentary schematic view of a portion of a carton as it is being formed from the blank of FIG. 1.
Figure 7:
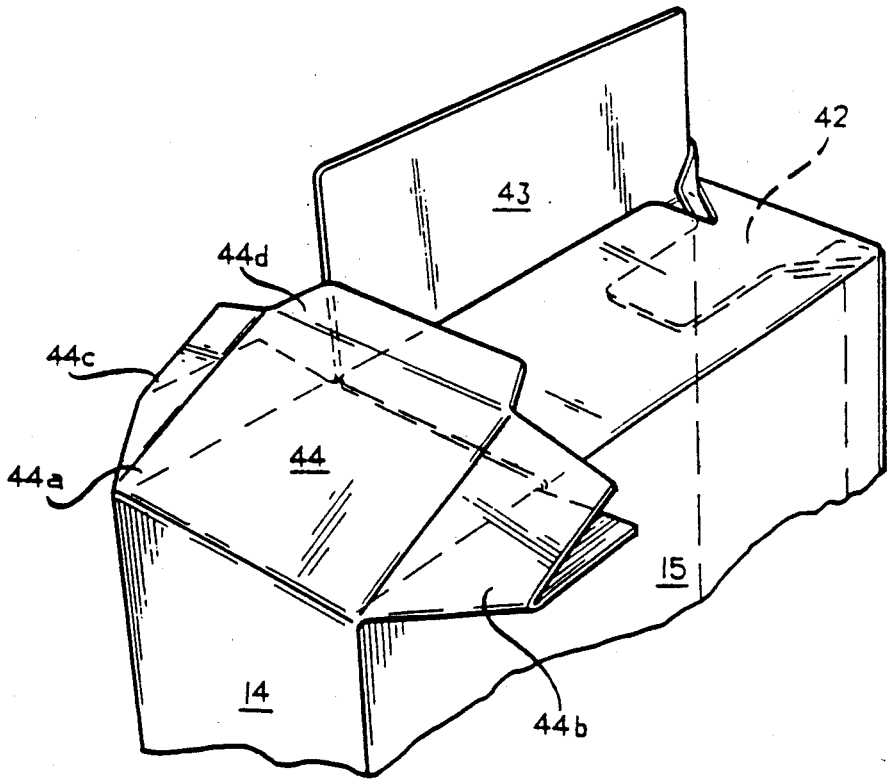
FIG. 7 is an enlarged fragmentary schematic view of the portion of the carton which is depicted in FIG. 6 at a subsequent stage of its formation.
Figure 8:
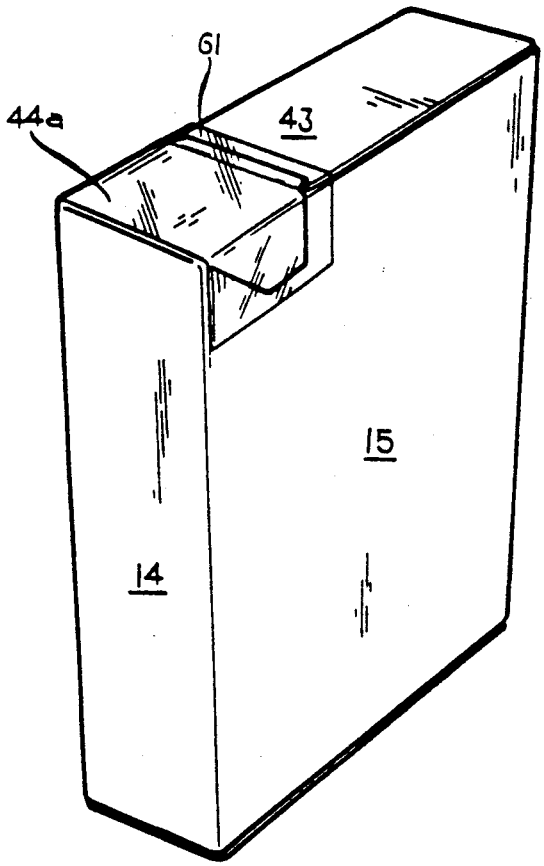
FIG. 8 is a schematic view showing the assembled carton which has been formed from the blank of FIG. 1.
Figure 9:
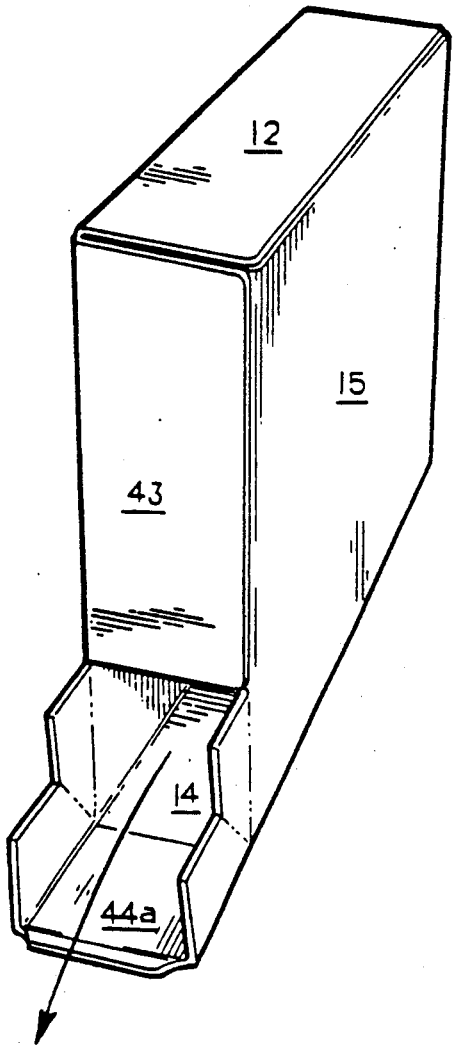
FIG. 9 is a schematic view showing the pour-out spout feature of the carton which has been formed from the blank of FIG. 1.

In the assembly of the carton, after the tubular structure of FIG. 4 has been formed, the L-shaped portions 44*b* and 44*c* of the flap 44 are folded outwardly along the fold lines 44*f* and 44*g*, respectively, as is shown in FIGS. 6 and 7, to bring the now-folded L-shaped portions 44*b* and 44*c* into positions extending outwardly from the central portion 44*a*. As is shown in FIG. 8, the outwardly projecting folded L-shaped portions are then folded downwardly to overlie the carton panels 15 and 13, respectively, and they are secured in these positions until the first opening of the carton by means of a short length of removable pressure sensitive tape 61. The package is shown in a partially inverted position in FIG. 9 in an opened position with the structure formed from the flap 44 constituting a pour-out spout, and the package can be reclosed, as is desirable when only a portion of the contents is withdrawn, by reclosing the pour-out spout into the configuration depicted in FIG. 8, and the reclosed carton can be secured in such position, without the need for reapplying the tape 61, or a replacement therefor, by bending the tab portion 44*d* of the flap 44 downwardly to insert it in the slot defined by the slots 52 and 53 of blank 11.

Figure 10:
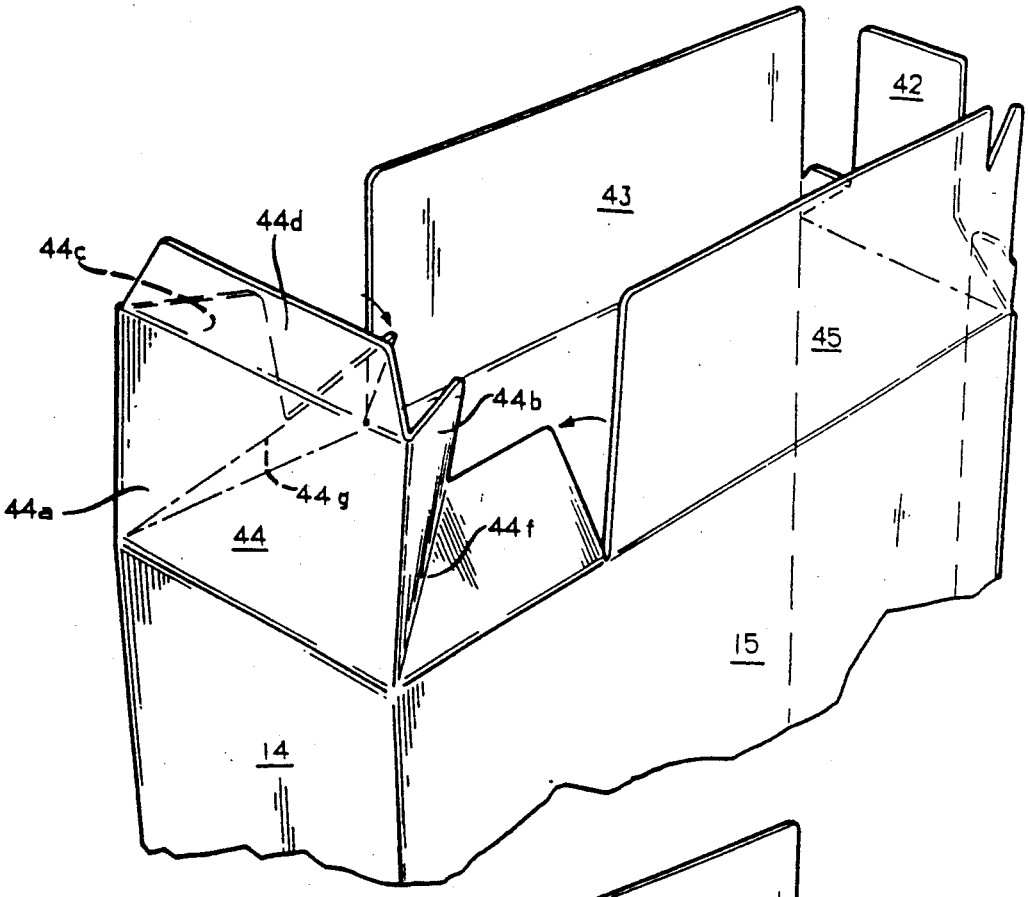
FIG. 10 is an enlarged fragmentary schematic view of a portion of a carton as it is being formed in an alternative manner from the blank of FIG. 1.
Figure 11:
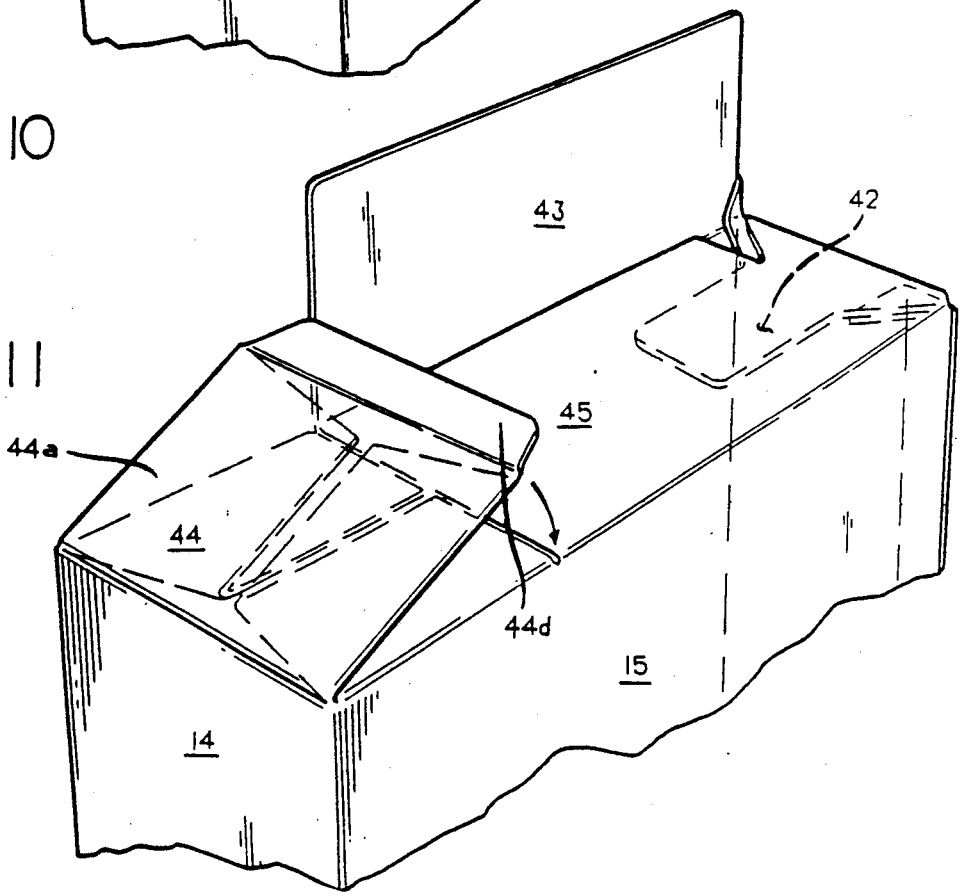
FIG. 11 is an enlarged fragmentary schematic view of the carton which is depicted in FIG. 10 at a subsequent stage of its formation.

As an alternative to the carton closing technique depicted in FIGS. 6 through 8, as is depicted in FIGS. 10 and 11, the flaps 44*b* and 44*c* can be folded inwardly along the fold lines 44*f* and 44*g*, respectively, so that the central portion 44*a* of the flap 44 will overlie portions 44*b* and 44*c*. Of course, the use of a length of tape to seal the assembled pour-out spout is also contemplated. This form of closure is somewhat neater in appearance than that depicted in FIGS. 6 through 8, but it does present an open seam of somewhat greater length to be sealed against the migration of air and moisture, and for that reason it may not be as desirable for some packaging applications. In any case, after the initial opening the pour-out spout can be reclosed as in the reclosing manner described in connection with the initial closing technique of FIGS. 6 through 8.

The best mode known to us to carry out this invention has been described above in terms sufficiently full, clear, concise and exact as to enable any person skilled in the art to make and use the same. It is to be understood, however, that it is within our contemplation that certain modifications of the above-described mode of practicing the invention can be made by a skilled artisan without departing from the scope of the invention and it is, therefore, desired to limit the invention only in accordance with the appended claims.

What is claimed is:

1. A die-cut blank of a foldable polymeric sheetlike material, a major portion of the thickness of said foldable polymeric sheetlike material comprising an expanded polymeric material, said blank comprising, in combination:

a series of four rectangularly-shaped panels which are separated from one another by scored fold lines, said panels being adapted to be folded with respect to one another along said fold lines into an open-ended tubular body portion of said carton;

flap means foldably attached to said series of panels along transverse scored fold lines extending between the fold lines separating said panels, said flap means being adapted to be folded with respect to said panels along said transverse scored fold lines to form end structure means sealingly closing an end of said tubular body portion of said carton;

second flap means foldably attached to three of said four panels in said series along second transverse scored fold lines, said second flap means being adapted to be folded with respect to said three panels along said second scored fold lines to form means sealingly closing a portion of the other end of said tubular body portion of said carton; and third flap means foldably attached to the fourth of said panels in said series and to the adjoining panels of said series of four panels on the opposite sides of said fourth panel along third transverse scored fold lines, said third flap means being adapted to be folded with respect to said fourth panel and to said adjoining panels to form a reclosable pour-out spout which sealingly closes the remaining portion of said other open end of said tubular body portion of said carton when said carton is in the closed position, said third flap means comprising:

a rectangular panel portion which is foldably attached to said fourth panel in said series along said third transverse fold line;

a pair of outwardly facing L-shaped portions on opposite sides of said rectangular panel portion, one leg of each L-shaped portion being foldably attached to one of the edges of said rectangular panel portion along a scored fold line, the other leg of each of said pair of L-shaped portions being foldably attached to the adjacent of said adjoining panels along a fourth transverse fold line which is aligned with said third transverse fold line;

tab means foldably attached to said rectangular panel portion along a tab means score line that is spaced from and extends generally parallel to said third transverse scored fold line; and slot means separating said third flap means from said second flap means, said slot means being adapted to have said tab means inserted into said slot means when said pour-out spout is in said closed position; and wherein said flap means comprises;

four flaps, each of said four flaps comprising an integrally formed portion of said blank and depending from and being foldable with respect to one of said panels along one of said transverse scored fold lines at the juncture between said each of said four flaps and said one of said panels, said four flaps being separated from one another by slots, each of said slots extending from the marginal edge of said blank adjacent said four flaps only partially to the fold lines between said panels and said flaps; and a plurality of gusset areas, each of said gusset areas lying between an adjacent pair of said flaps when said end structure means is formed by the inward folding of each of said four flaps to seal the corner of said carton that is adjacent said adjacent pair of said flaps, each of said gusset areas being compressed in the die-cutting step to a thickness of no more than about one-half of the thickness of said blank to reduce the thickness of the corners of said end structure means.

2. A blank according to claim 1 wherein said sheetlike material comprises a thin layer of a non-expanded polymeric material on one of the opposed surfaces thereof for improved resistance to moisture vapor transmission.

3. A blank according to claim 2 wherein said sheetlike material further comprises a second thin layer of a non-expanded polymeric material on the other of the opposed surfaces thereof.

4. A blank according to claim 2 wherein said expanded polymeric material comprises expanded polystyrene, wherein said thin layer of said non-expanded polymeric material comprises polyethylene and wherein said sheetlike material further comprises a bonding agent for bonding said thin layer of said non-expanded polymeric material to said expanded polymeric material.

5. A blank according to claim 4 wherein said bonding agent comprises ethylene vinyl acetate.

* * * * *